US009528438B2

(12) United States Patent
Balistrere et al.

(10) Patent No.: US 9,528,438 B2
(45) Date of Patent: Dec. 27, 2016

(54) ENGINE CLEANING PROCESS

(71) Applicants: Lance Balistrere, New Albany, OH (US); William Beichner, McMurray, PA (US); Chad Flanagan, Worthington, OH (US)

(72) Inventors: Lance Balistrere, New Albany, OH (US); William Beichner, McMurray, PA (US); Chad Flanagan, Worthington, OH (US)

( * ) Notice: Subject to any disclaimer, the term of this patent is extended or adjusted under 35 U.S.C. 154(b) by 113 days.

(21) Appl. No.: 14/529,703

(22) Filed: Oct. 31, 2014

(65) Prior Publication Data

US 2015/0122341 A1 May 7, 2015

Related U.S. Application Data

(60) Provisional application No. 61/898,526, filed on Nov. 1, 2013.

(51) Int. Cl.
*B08B 3/00* (2006.01)
*F02B 77/04* (2006.01)

(52) U.S. Cl.
CPC ..... *F02B 77/04* (2013.01); *Y10T 29/49815* (2015.01); *Y10T 137/0402* (2015.04)

(58) Field of Classification Search
CPC ..... F02B 77/04; Y10T 29/49815; Y10T 137/0402
USPC ..... 134/34; 137/15.01; 206/223; 29/426.1
See application file for complete search history.

(56) References Cited

U.S. PATENT DOCUMENTS 5,085,192 A * 2/1992 McDougal ..... F02B 77/04 123/406.2
5,460,656 A * 10/1995 Waelput ..... F02B 77/04 123/196 A
2008/0060680 A1* 3/2008 Esterline ..... B08B 3/00 134/22.1

* cited by examiner

*Primary Examiner* — Eric Golightly
(74) *Attorney, Agent, or Firm* — Porter Wright Morris & Arthur LLP

(57) ABSTRACT

A method of using a kit to clean an injection combustion engine while the engine is running comprising removing a vacuum hose attached to the engine, inserting a tube attached to a compartment containing a liquid cleaning chemical inside the hose, introducing the chemical into the engine's fuel system in a controlled fashion, removing the tube from the hose after the recommended amount of chemical is in the engine's fuel system and reattaching the hose.

10 Claims, 3 Drawing Sheets

ENGINE CLEANING PROCESS

CROSS-REFERENCE TO RELATED APPLICATIONS

This application claims the benefit of U.S. provisional patent application Ser. No. 61/898,526 filed Nov. 1, 2013, which is hereby incorporated by reference in its entirety.

TECHNICAL FIELD

The invention relates generally to an improved process for flushing buildup from the fuel system of an engine and specifically to a do-it-yourself, no special tools needed method of safely introducing a liquid chemical to the cylinders of a port, multiport or direct injection engine through a vacuum hose in a controlled manner.

BACKGROUND

A properly functioning internal combustion engine is reliant upon a clean efficient fuel delivery system. As the engine becomes older and is used longer, the fuel delivery system is subject to harmful deposits from unburned fossil fuels. This condition disrupts the engine's performance. Even in the most efficient engine, not all of the fuel is burned. Deposits are formed that are baked into the fuel system from the injector to the valve, to the throttle plate to the combustion chamber to the exhaust system.

An engine fuel system cleaning procedure removes the deposits such as, but not limited to, gum and varnish. In a cleaning, chemicals are poured into the engine and the engine is run at idle for a few minutes to circulate the chemical and clear the deposits. The chemicals are cleaning agents that are hazardous to the eyes and skin, and are extremely flammable. Cleaning is typically performed about every 15000 miles of use.

Presently, there is no easy way to get the chemical into the engine's fuel system. The existing method is to pour the chemical into an open container, remove the vacuum hose while the vehicle is running, and dip the end of the hose in the liquid to siphon the chemical into the engine. Because the hose is short, the user typically puts the open container on the running engine.

There are many disadvantages of the existing method. Using the open container, the chemical can splash onto a user's skin and eyes and create a medical problem. If the container were to tip or spill, the chemical, because it is combustible and flammable, would cause a fire upon contact with the heated engine. In addition, the chemical has to be introduced into the engine a slow rate. If too much chemical is introduced too quickly—typically by submerging the hose in the liquid—a vapor lock will result and the car will not start. The existing method cannot control the delivery rate of the chemical. Further, when suctioning, the user allows air to enter the vacuum hose. The addition of air may actually create additional deposits.

A need exists for a method of introducing a fluid cleaning chemical into an engine's fuel system in a safe and controlled manner. A need exists for a method that cleans dirty internal parts (including intake valves and pistons) by removing harmful gums, varnish and carbon in addition to moisture from oil crankcases. A need exists for a method to diminish an engine's hesitations, stalls, pings and rough idle due to carbon buildup and restore power and pick up. A need exists for a method to address sticking lifters and rings and lubricate upper cylinders. A need exists for a method of cleaning PVC valve systems to increase RPMs, vacuum and compression.

SUMMARY OF THE DISCLOSURE

The present invention is a method of cleaning an injection-type engine's fuel system. The method is performed while the engine is running. To perform the method, a user removes a vacuum hose attached to the engine at a far end of the hose such that the hose is attached to the engine and has a free end. In an embodiment, the hose is the main manifold vacuum line, but any vacuum hose that distributes evenly to all cylinders will work. The user inserts a first end of a tube inside the free end of the hose. The second end of the tube is attached to a compartment containing a liquid cleaning chemical such that the liquid can flow through the tube in a controlled fashion. The user removes the tube from the hose after the chemical is evacuated from the compartment through the tube into the hose and into the engine. After the recommended amount of chemical has been introduced into the engine, the hose is reattached.

In an embodiment, the compartment is a barrel of a syringe and the chemical is pushed into the hose using a plunger in communication with a barrel of the syringe. The syringe holds about 2 fluid ounces of chemical. The syringe is refilled and the process is repeated two additional times such that about 6 ounces of chemical is used in the cleaning.

In an embodiment, the method is performed using a kit comprising a reusable container and a bottle containing an engine cleaning chemical solution. In an embodiment, the container is a syringe that has a tapered delivery tube. The delivery tube is about 1¼ inch long with a diameter that tapers from about ½ inch at the connection to the barrel to about ¼ inch at the end that is inserted into the hose. In an embodiment, the barrel of the syringe has a capacity of about 2 fluid ounces and the bottle has a capacity of about 12 fluid ounces.

In an alternate embodiment, the compartment is a collapsible plastic pouch that collapses as the fluid chemical is vacuumed into the engine's fuel system.

In an embodiment, a kit comprises a delivery tube and a storage compartment. The delivery tube is about 5.25 inches long with a barrel having a diameter of about 1 inch. The barrel has an opening at a first end equal to its inner diameter and a tapered nipple at a second end opposite the first end. The nipple has an exit opening of about 0.25 inches in diameter. The compartment is a bottle containing about 5.25 ounces of the cleaning solution. The bottle has a first portion that has a smaller diameter than a remainder portion of the bottle. The first portion outer diameter is slightly less than the inner diameter of the barrel. The first portion has an opening that has a removable cap. To use, the uncapped opening of the bottle is inserted into the opening of the barrel and the nipple is inserted into the vacuum hose. After the chemical is evacuated from the bottle, the nipple is removed from the hose and it is reattached to the engine.

The device and method of the present invention can comprise, consist of, or consist essentially of the essential elements and limitations of the invention described herein, as well as any additional or optional components or limitations described herein or otherwise useful in systems and methods of the general type as described herein. All combinations of method or process steps as used herein can be performed in any order, unless otherwise specified or clearly implied to the contrary by the context in which the referenced combination is made.

As used herein, the term "about" means between ½ and 2 times the term it qualifies.

DETAILED DESCRIPTION OF THE DRAWINGS

The disclosure is directed to a method of safely introducing a liquid cleaning chemical into an engine's fuel system through the vacuum hose in a controlled fashion. The method uses a closed container to slowly introduce a measured amount of the cleaning chemical into the interior of the vacuum hose for introduction into the engine's fuel delivery system.

Figure 1:
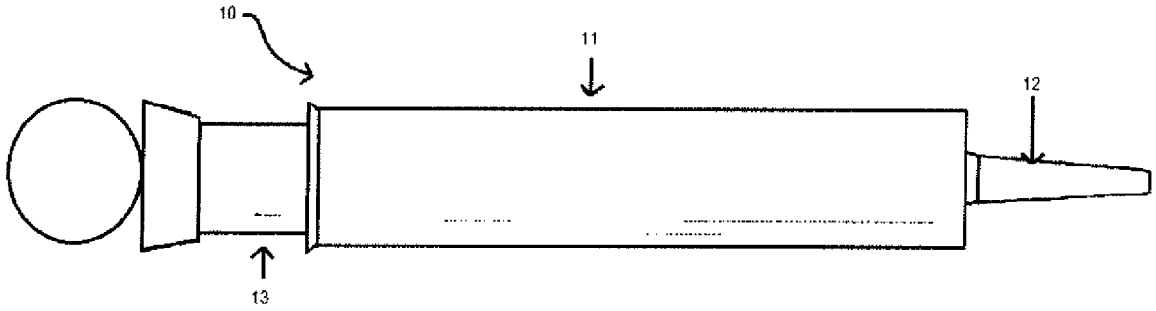
FIG. 1 is a side view of an embodiment of the device used in the process.

Referring to FIG. 1, in an embodiment, the container 10 is a device having a storage compartment 11 and a delivery tube 12. In the embodiment depicted in FIG. 1, the container 10 is a standard cooking syringe. The syringe has a 4 inch long barrel (storage compartment) 11 having a diameter of about 1 inch and a nipple (delivery tube) 12 that is about 1¼ inch long with a diameter that tapers from about ½ inch at the connection to the storage compartment to about ¼ inch at the open end. The tube may have a removable cap at the open end. The diameter of the delivery tube and the delivery tube opening limits the flow so that the flow rate of the chemical introduced to the engine is slow and steady. As shown in FIG. 1, the depicted embodiment has a plunger 13 for a user to push the chemical into the hose. In alternate embodiments, the storage compartment is any contained collapsible pouch having a delivery tube extending from the pouch. The container may be fabricated from plastic, cardboard, films or other substances that are inert to the chemical. The container may be compatible with an adaptor that allows use on a variety of diameters of vacuum hoses.

An important element of the invention is the size of the opening of the tube or nipple. The rate of flow is determined by the amount of negative pressure produced by the vacuum together with resistance of the tubing and the viscosity of the chemical. In an embodiment, the chemical has a low viscosity, about the viscosity of water at room temperature. The most important factor affecting the flow is the inner diameter of the opening of the tube or nipple, which restricts the flow. In an embodiment having a 5.25 inch compartment/delivery tube with a diameter tapering from about 1 inch to about 0.5 inch, the diameter of the opening that creates sufficient restricted flow of the chemical is about 0.25 inch.

The method of the invention comprises removing the vacuum hose of the engine while the vehicle is running (or starting the car after removal) and inserting the delivery tube within the diameter of the vacuum hose. In the embodiment depicted in Figures, the tapered delivery tube allows for use with many different sizes of vacuum hoses. The tube is inserted until the outside of the tapered tube mates with the end of the open hose. In an embodiment where the storage compartment is prefilled, the required amount of chemical is loaded in the storage compartment. In an alternate embodiment, the storage compartment is refillable. In the embodiment depicted in FIG. 1, the syringe is filled and refilled from a bottle of chemical.

In an embodiment, the container is packaged in kit form with a bottle of chemical with instructions for reusable use. The kit may contain additional items, such as a funnel, a hose adaptor, and the like.

Figure 2:
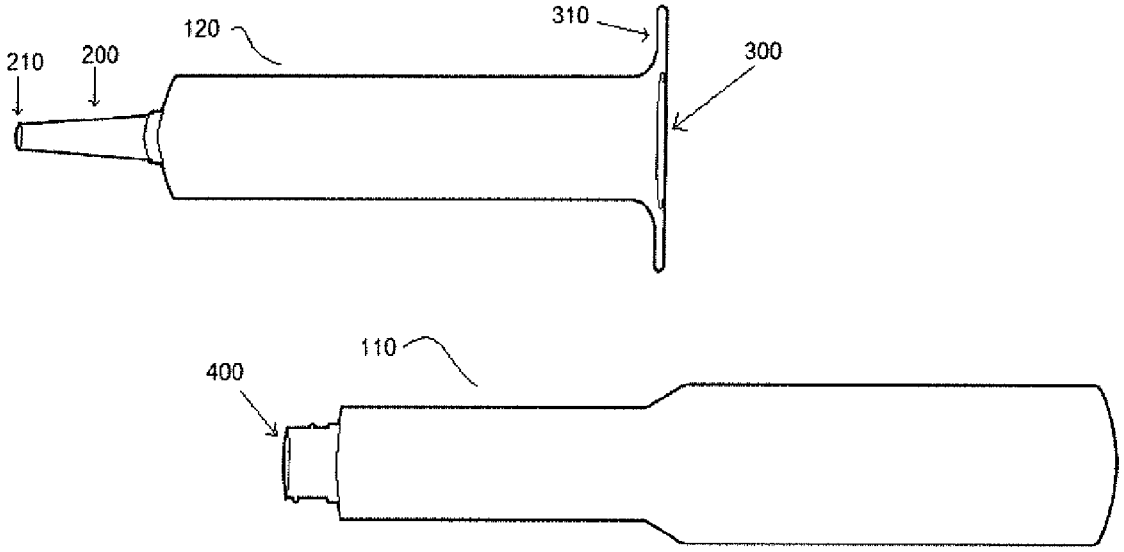
FIG. 2 is a side view of a kit embodiment of the invention.
Figure 3:
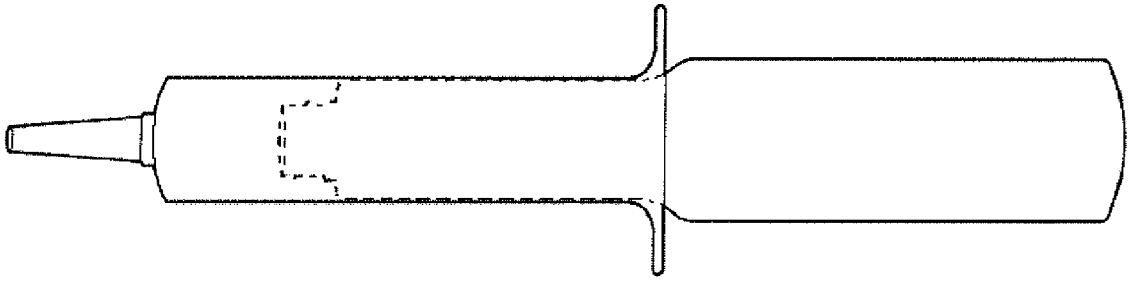
FIG. 3. is a side view of an embodiment with the container assembled to the bottle.

In an embodiment depicted in FIG. 2, a kit contains a delivery tube 120 and a storage compartment 110. In an embodiment, the delivery tube 120 is an object similar to the barrel of a typical cooking syringe, with a tapered section 200 having an exit opening 210. The opposite end of the tube has an entrance opening 300. The tube has a flange 310. Included in the tube is a prefilled storage compartment 110. In an embodiment, the storage compartment 110 is a prefilled 5.25 ounce bottle of chemical having a capped opening 400 (cap not shown). As shown in FIG. 2, at least a portion of the compartment at the capped opening has an outer diameter that is slightly less than an inner diameter of the delivery tube at the entrance opening. For use, the cap is removed from the container, the opening is inserted into the entrance opening of the delivery tube as far as it will go (see FIG. 3). The exit opening 201 is inserted into the vehicle vacuum hose, and the chemical flows into the engine's fuel line. When the compartment (bottle) is empty, the vacuum hose is removed from the tube and reattached to the vehicle.

In an embodiment, the chemical is a liquid hydro treated petroleum distillate solution comprising:

| CHEMICAL | CAS # | OSHA PEL | ACGIH TLV | OTHER |
|---|---|---|---|---|
| Solvent Naphtha (Petroleum), Light Aliphatic | 64742-89-8 | 500 ppm | 300<br>1370 mg/m$^3$ | |
| Heavy Hydrotreated Naphthenic Distillates (petroleum) | 64742-52-5 | 5 ppm | 5 ppm | |
| Distillates Petroleum, Hydrotreated Light | 6742-47-8 | — | — | |
| Isopropanol | 67-63-0 | 400 ppm<br>980 mg/m$^3$ | 200 ppm<br>400 ppm STEL | |

Other ingredients may be added to the solution, and the substances listed above may be varied in amount. The strength of the chemical may be varied up to about double strength.

In an embodiment, the storage compartment holds about 2-8 fluid ounces of chemical. The user may refill the storage compartment for multiple doses or use on a second vehicle.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

We claim:

1. A method of cleaning an internal combustion engine while running comprising:

(a) disconnecting a first end of a vacuum hose having first and second ends connected to an engine fuel delivery system such that the first end is detached from the engine and the second end remains attached to the engine and in fluid communication with the engine's fuel delivery system;

(b) connecting the first end of the vacuum hose to a closed storage container containing a predetermined quantity of liquid cleaning fluid through to a fluid communication path that includes a fixed, non-variable flow restriction;

(c) exposing the liquid cleaning fluid in the closed storage container to a partial vacuum created in the engine's fuel delivery system through the fluid communication path;

(d) evacuating a predetermined quantity of liquid cleaning fluid from the closed storage container through the fixed, non-variable flow restriction, and introducing the evacuated cleaning fluid into the engine's fuel delivery system; and reattaching the first end of the vacuum hose to the engine after the first end of the vacuum hose has been disconnected from the fluid communication path to the container.

2. The method of claim 1 wherein the storage container is a barrel of a syringe having a plunger and the cleaning solution is pushed out of the storage container using the plunger of the syringe.

3. The method of claim 1 wherein the storage container is a collapsible plastic pouch that collapses as the cleaning solution is evacuated from the pouch.

4. The method of claim 1 wherein the storage container has a tubular syringe configuration with a narrowed outlet end section on one end.

5. The method of claim 4 further comprising the steps of refilling the syringe with the cleaning solution and pushing the cleaning solution into the engine.

6. A method as recited in claim 4 wherein the predetermined amount is about 5.25 fluid ounces of cleaning solution.

7. A method as recited in claim 1 wherein the flow restriction includes a tapered section having an outer diameter whereby the tapered section is adopted to interface with different internal diameters.

8. A method as recited in claim 1 wherein the compartment is prefilled with an amount of cleaning fluid required to clean the engine.

9. A method as recited in claim 1 wherein the compartment is prefilled with an amount of liquid cleaning fluid required to clean the engine, and the liquid cleaning fluid is subjected to a partial vacuum created in the engine fuel delivery system until all of the liquid cleaning fluid is evacuated from the compartment.

10. A method of cleaning an internal combustion engine while the engine is running, comprising:

opening a capped, closed storage container by removing a cap from one end of the container;

inserting at least a portion of the end of a storage container with the removed cap having a predetermined outer diameter into a delivery tube into an entrance end of a delivery structure, the delivery structure having an entrance opening at one end and an exit opening with a fixed, non-variable flow restriction in the opposite end, the delivery structure having an internal diameter slightly larger than the outer diameter of the portion of the storage container;

disconnecting a first end of a vacuum hose of an internal combustion engine so that a second end of the vacuum hose, opposite the first end, so that the first end of the vacuum hose is detached from the engine and the second end is attached to an engine and in fluid communication with the engine's fuel delivery system;

connecting the disconnected first end of the vacuum hose to a closed compartment containing a predetermined quantity of liquid cleaning fluid through to a fluid communication path that includes a fixed, non-variable flow restriction;

exposing the liquid cleaning in the storage container to a partial vacuum created in the engine's fuel delivery system;

evacuating the predetermined quantity of liquid cleaning fluid from the closed compartment through the fixed, non-variable flow restriction, and introducing the evacuated cleaning fluid into the engine's fuel delivery system; and reattaching the first end of the vacuum hose to the engine after the first end of the vacuum hose to the engine after the predetermined amount of liquid cleaning fluid has been introduced into the engine's fuel delivery system.

* * * * *